US006612013B2

(12) United States Patent
Zardus et al.

(10) Patent No.: US 6,612,013 B2
(45) Date of Patent: Sep. 2, 2003

(54) METHOD OF LOOSELY ATTACHING BLIND RIVET

(75) Inventors: Paul M. Zardus, Royal Oak, MI (US); Pei-Chung Wang, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/800,611

(22) Filed: Mar. 8, 2001

(65) Prior Publication Data

US 2002/0124380 A1 Sep. 12, 2002

(51) Int. Cl.[7] ..... B21J 15/02; B23P 19/02; B23P 11/00; B21B 45/04

(52) U.S. Cl. ..... 29/525.06; 29/525.05; 29/525; 29/243.521; 72/391.4

(58) Field of Search ..... 29/525.06, 525.05, 29/525, 243.521, 243.523, 243.524, 243.525, 243.529; 72/391.2, 391.4

(56) References Cited

U.S. PATENT DOCUMENTS 4,368,810 A * 1/1983 Maucher et al. ..... 192/70.28
5,533,260 A * 7/1996 Kier, Jr. ..... 29/894.322

* cited by examiner

*Primary Examiner*—John C. Hong
(74) *Attorney, Agent, or Firm*—Kathryn A. Marra

(57) ABSTRACT

A method and apparatus are provided for loosely attaching blind rivets to components of an assembly. The method includes attaching a rivet to an assembly while positioning the head at a predetermined clearance away from the adjacent one of the assembly components. One or both of the aligned openings in the components may be enlarged to leave radial clearance between the assembled rivet body and the enlarged openings. The apparatus includes a nose insert for use with or attachment to a rivet gun or attaching apparatus. The insert forms a stop engageable by a preformed rivet head to maintain a predetermined clearance between the rivet head and adjacent component when the rivet is attached to components forming an assembly.

5 Claims, 3 Drawing Sheets

METHOD OF LOOSELY ATTACHING BLIND RIVET

TECHNICAL FIELD

This invention relates to blind riveting, that is, riveting performed from a single side of a workpiece assembly. In particular, the invention pertains to loose application of blind rivets to an assembly.

BACKGROUND OF THE INVENTION

It is known in the art relating to riveting to apply blind rivets from a single side of a workpiece assembly of two or more components. In the assembly process, holes are formed in the components, which are placed in engagement with the holes aligned to receive the hollow body of a blind rivet having a preformed head at one end. The rivet includes a mandrel with a stem extending through the hollow body and an enlarged end engaging a headless (blind) end of the body.

The rivet is held by a rivet gun with the stem of the mandrel inserted into an opening in a nose of the gun and the outer head of the rivet against the nose. The body of the rivet is inserted fully into the aligned holes in the components, and the gun is actuated to draw the mandrel outward through the preformed head. The enlarged end of the mandrel deforms the blind end of the body to create a blind head that pulls the components together and expands the body to fill the aligned holes while the nose of the gun forces the outer head against the adjacent component of the assembly. The result is a riveted joint that maintains the components in tightly fixed assembly.

FIGS. 1–3 illustrate steps in the prior art setting or application of one of the many forms of blind rivets to fix together two components of a component assembly 10. FIG. 1 shows a blind rivet 12 having a hollow body 14 with a preformed head 16 at one end. A mandrel 18 has a stem 20 connecting with an enlarged end 22 forming a conical wedge engaging the blind end 23 of the body 14 opposite from the head 16. The body 14 is shown inserted through aligned holes 24, 26, respectively, in adjacent components 28, 30 of the assembly. The rivet head is engaged by a nose 32 of any form of rivet gun or setting apparatus, not further illustrated. The components 28, 30 are shown spaced apart for clarity but would preferably be placed in engagement adjacent the holes 24, 26 prior to setting the rivet. The rivet gun includes mechanism, not shown, that grips the stem 20 of the mandrel for subsequently drawing the enlarged end outward in the direction of the rivet head 16.

FIG. 2 shows the assembly 10 after actuation of the rivet gun to set the rivet 12. The enlarged end 22 of the mandrel 18 has been drawn into the hollow body 14 of the rivet 12, enlarging the blind end 23 of the rivet against the distal component 30 and expanding the body to fill the holes 24, 26 while the nose 32 of the rivet gun remains against the preformed head 16 of the rivet, forcing the head against the adjacent component 28.

In FIG. 3, the stem 20 has been broken off flush with the rivet head and removed with the rivet gun nose 32, leaving the remainder of the mandrel 18 fixed to the interior of the hollow rivet body 14 while the body has been expanded into engagement with the aligned holes 24, 26. The head 16 remains in engagement with the adjacent component 28 while the enlarged blind end 23 engages the distal component 30, thereby holding the components 28, 30 in fixed engagement.

In a particular application, hydroformed frame components are held in pre-assembly by blind rivets prior to welding into a strong frame assembly. However, the riveted joints may be too constrained to accommodate variations in the parts that require adjustment of the joint connections to meet dimensional requirements of the frame prior to welding.

SUMMARY OF THE INVENTION

The present invention provides a method and apparatus for loosely attaching blind rivets to components of an assembly. The method includes attaching a rivet to an assembly while positioning the head at a predetermined clearance away from the adjacent one of the assembly components. One or both of aligned openings in the components may also be enlarged to leave radial clearance between the assembled rivet body and the enlarged openings.

The apparatus includes a nose insert for use with or attachment to a rivet gun or attaching apparatus. The insert is formed as a member having a hollow center for receiving the stem of a mandrel or the nose of a conventional rivet gun. The member includes a first portion engageable with an associated rivet gun, a second portion engageable by a preformed rivet head, and a third portion engageable with a component adjacent to the rivet head and configured to maintain a predetermined clearance between the rivet head and the component when the rivet head is engaging the second portion.

These and other features and advantages of the invention will be more fully understood from the following description of certain specific embodiments of the invention taken together with the accompanying drawings.

DESCRIPTION OF THE PREFERRED EMBODIMENT

Figure 1:
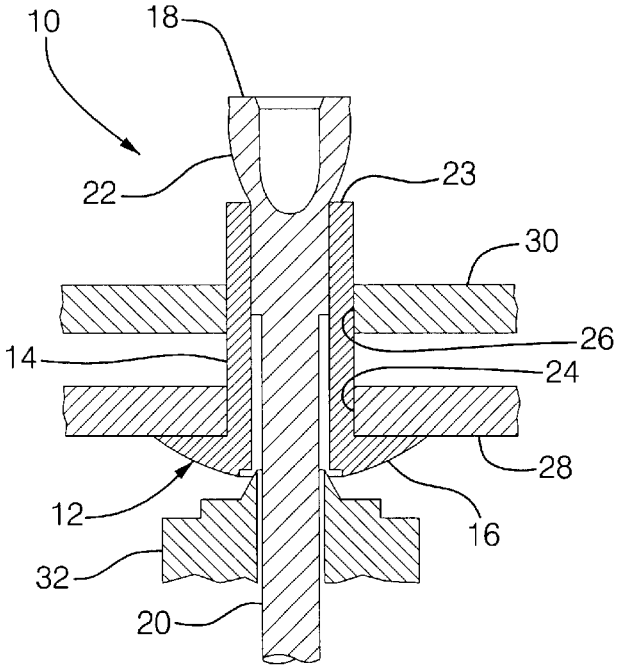
PRIOR ART FIG. 1
FIGS. 1–3 are cross-sectional views showing progressive prior art steps in the setting of a blind rivet joining components of an assembly.
Figure 2:
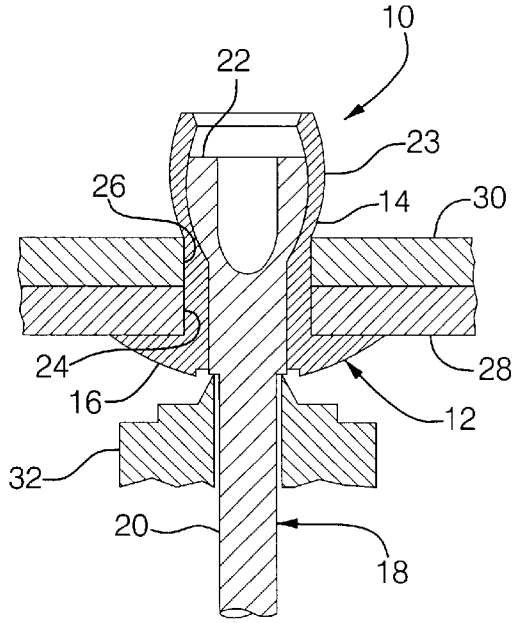
PRIOR ART FIG. 2
Figure 3:
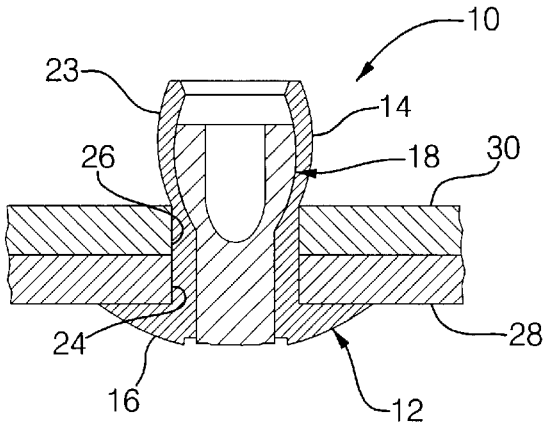
PRIOR ART FIG. 3
Figure 4:
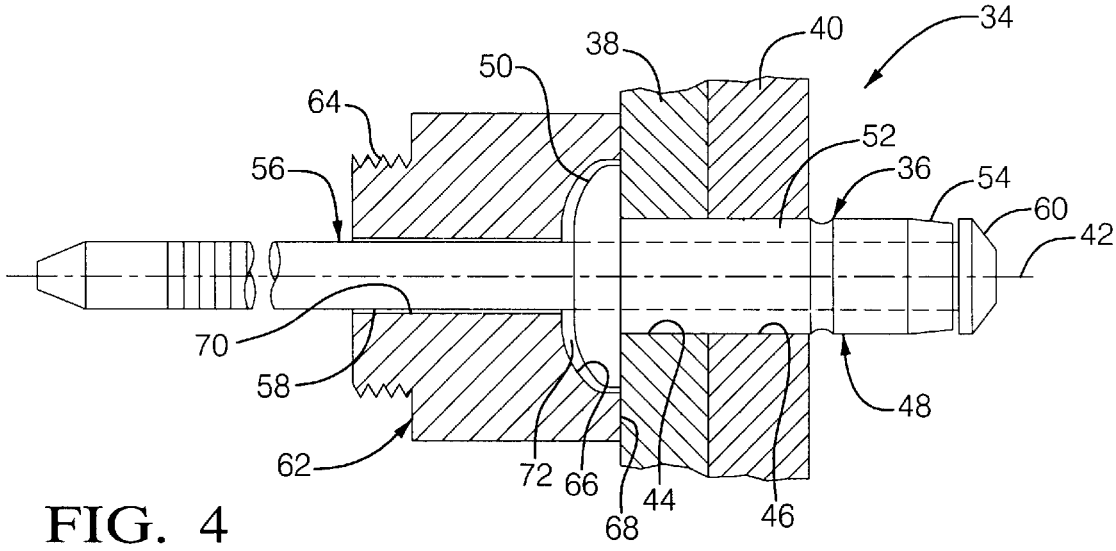
FIGS. 4–6 are cross-sectional views of progressive steps in the setting of an alternative form of blind rivet using the method and apparatus of the present invention.
Figure 5:
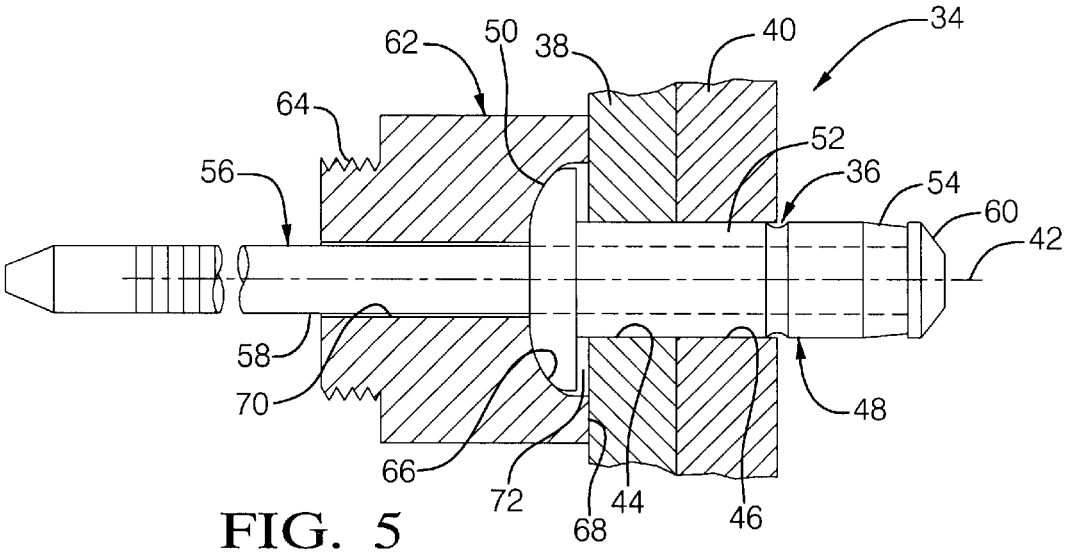
Figure 6:
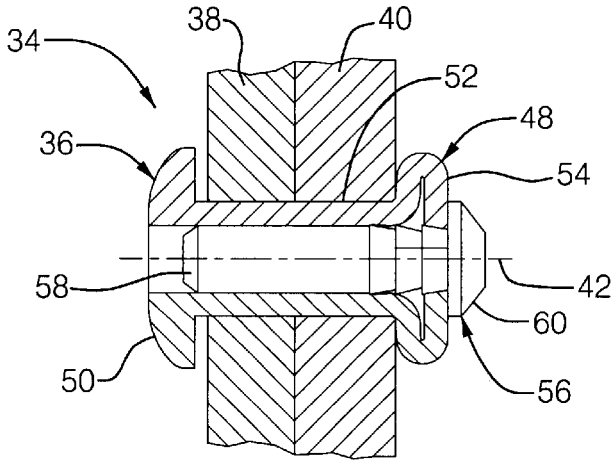

Referring now to FIGS. 4–6 of the drawings in detail, numeral 34 generally indicates an assembly of a blind rivet 36 and two components 38, 40 to be held in near engagement along an axis 42 of aligned openings 44, 46, respectively. The rivet 36 has a hollow body 48 including a head 50, hollow shank 52 and collapsible blind end 54. A mandrel 56 has a stem 58 extending through the body 48 and a head or enlarged portion 60 engaging the blind end 54 of the rivet 36. In the first assembly step pictured in FIG. 4, the head 50 engages the adjacent component 38, the shank 52 extends through the openings 44, 46, and the blind end protrudes from the rear of the distal component 40.

Figure 7:
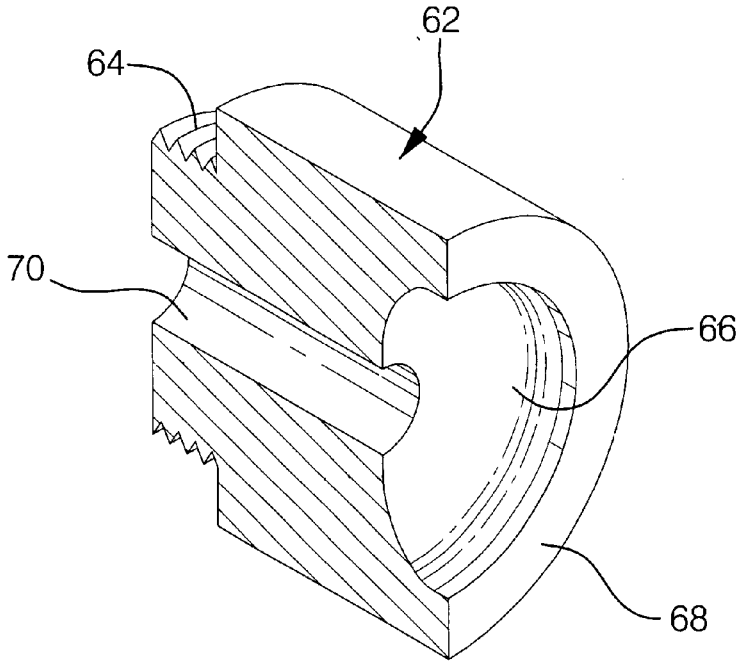
FIG. 7 is a pictorial view of an exemplary embodiment of a nose insert according to the invention.

A nose insert or stop 62 according to the invention is provided as shown also in FIG. 7. Insert 62 is mounted on the rivet gun or other assembly equipment, not shown, and either replaces or is mounted on or around the nose member usually provided. Insert 62 is formed as a hollow member having a first portion 64 engageable with the rivet gun, a second portion 66 engageable by the rivet head and a third portion 68 engageable with the adjacent component 38. As shown in the exemplary embodiment of FIGS. 4, 5 and 7, the first portion is a threaded outer end 64, the second portion is the inner wall 66 of a dished recess, and the third portion is an annular abutment or end 68 surrounding the recess. An axial opening 70 extends axially through the insert for receiving the stem 58 of the rivet mandrel. The various portions 64, 66, 68 and the opening 70 could, of course, be modified as appropriate for providing their various functions with differing rivet guns or components.

In an early assembly step as shown in FIG. 4, the rivet 36 is inserted into the aligned axial openings 44, 46 of the components 38, 40 with the rivet head 50 preferably, but not necessarily, engaging the adjacent component 38. The third portion or end 68 of the nose insert 62 is positioned to also engage the adjacent component 38, and the second portion or inner wall 66 of the recess surrounds the rivet head 50. If the head 50 engages the adjacent component 38, then it is also axially spaced from the second portion 66 or wall of the recess by a desired clearance or gap as shown in FIG. 4.

FIG. 5 illustrates an intermediate position during assembly wherein the rivet gun has been actuated to grasp the stem 58 and has drawn the mandrel 56 axially outward to engagement of the rivet head 50 with third portion of the insert, namely the inner wall 66 of the recess. The nose insert then acts as a stop, preventing further outward motion of the head 50 and positioning the head at a distance from the adjacent component 38 equal to the desired clearance or gap 72.

As the action of the actuated rivet gun continues to draw the mandrel 56 outward, the blind end 54 of the rivet is then deformed by bending radially out as shown in FIG. 6. The deformed end forms a flange that engages the distal component 40, and an outer portion of the stem is snapped off at a weakened point within the rivet body 48. The rivet gun and nose insert 62 are then removed and the assembly 34 is completed as shown in FIG. 6. The clearance or gap 72 remains between the rivet head 50 and the adjacent component 38 (or between other portions of the assembly) so that the components 38, 40 are not tightly fixed together but may be rotated relatively around the body 48 of the rivet.

Figure 8:
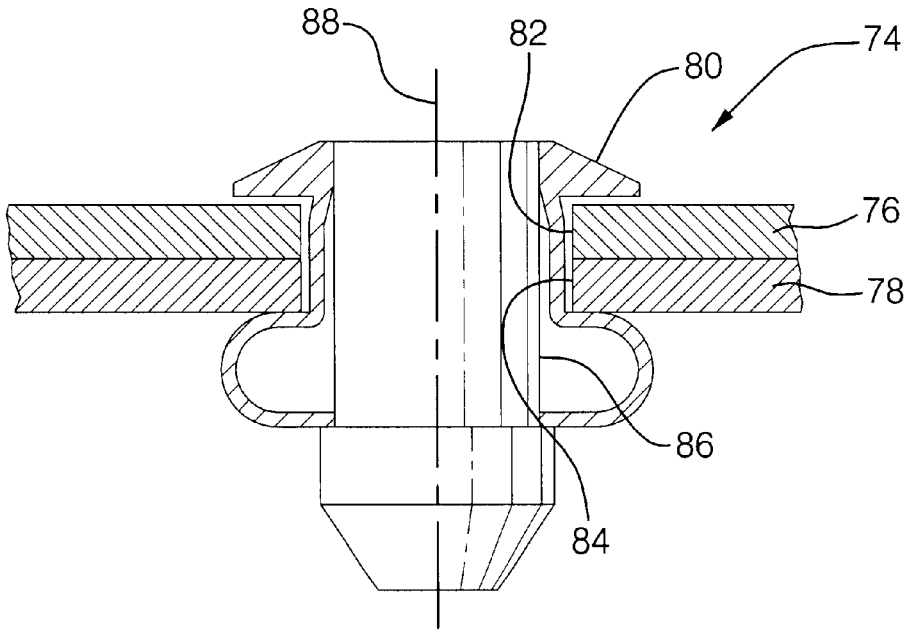
FIG. 8 is a cross-sectional view of an assembly utilizing a varied form of blind rivet applied to enlarged openings of the associated components.

Optionally, the holes 44, 46 (or at least one of them) may be initially made larger than the shank 52 so that some freedom for lateral adjustment of the components is also provided. This option is illustrated in FIG. 8, which shows an assembly 74 with components 76, 78 held loosely together by a blind rivet 80 received in enlarged openings 82, 84. The openings are made larger than the body 86 of the rivet to provide radial clearance, and the finished body 86 is made slightly longer (by the method of the invention) than the combined thicknesses of the components 76, 78. The components may thus be adjusted a prescribed amount laterally and/or angularly about the axis 88.

The concept of the invention illustrated in FIG. 8 allows a desired amount of freedom to adjust an assembly of components held together by loosely mounted blind rivets as shown. The application of the concept to an assembly of hydroformed frame components prior to their final welding into a sturdy fixed frame allows components to be loosely assembled without a fixture and then to be adjusted for fitting into a welding fixture for the final welding process. This allows the frame to be made from components with less demanding tolerances than would be required where conventional blind rivet assembly processes are utilized.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A method of loosely attaching blind rivets to components of a component assembly, the method comprising:

placing the components in engagement with one another and aligning openings through engaged portions of the components for receiving a hollow body of a blind rivet;

inserting through the openings the body of a blind rivet having a head at one end and a mandrel extending through the body and out through the head; and attaching the rivet to the assembly by drawing the mandrel partially through the body from the head end of the body to deform the body against an opposite side of the assembly while positioning the head at a predetermined clearance away from an adjacent component of the components of the assembly.

2. A method as in claim 1 including forming the opening in at least the adjacent component sufficiently large to remain loose around the body of the rivet after assembly of the rivet into the assembly.

3. A method as in claim 1 wherein positioning the head includes providing a stop engaging the adjacent component and having a portion engaged by the rivet head during the attaching step.

4. A method of loosely attaching blind rivets to components of a component assembly, the method comprising:

placing the components in engagement with one another and aligning openings through engaged portions of the components for receiving a hollow body of a blind rivet;

inserting through the openings the body of a blind rivet having a head at one end and a mandrel extending through the body and out through the head;

attaching the rivet to the assembly by drawing the mandrel partially through the body from the head end of the body to deform the body against an opposite side of the assembly while positioning the head at a predetermined clearance away from an adjacent component of the components of the assembly by providing a stop engaging the adjacent component and having a portion engaged by the rivet head during the attaching step; and providing a rivet gun for attaching the rivet and locating the stop between a nose of the rivet gun and the adjacent assembly component.

5. A method as in claim 4 including attaching the stop to the nose of the rivet gun.

* * * * *